US011548066B2

(12) United States Patent
Ozaki et al.

(10) Patent No.: US 11,548,066 B2
(45) Date of Patent: Jan. 10, 2023

(54) INJECTION MOLDING MATERIAL FOR MAGNESIUM THIXOMOLDING

(71) Applicant: SEIKO EPSON CORPORATION, Tokyo (JP)

(72) Inventors: Koichi Ozaki, Okayama (JP); Tadao Fukuta, Kurashiki (JP); Yasutoshi Hideshima, Nagano (JP); Hidefumi Nakamura, Aomori (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/207,797

(22) Filed: Mar. 22, 2021

(65) Prior Publication Data

US 2021/0291262 A1 Sep. 23, 2021

(30) Foreign Application Priority Data

Mar. 23, 2020 (JP) ..... JP2020-050632

(51) Int. Cl.
*B22F 1/00* (2022.01)
*B22F 3/22* (2006.01)

(52) U.S. Cl.
CPC ..... *B22F 1/0003* (2013.01); *B22F 3/225* (2013.01); *B22F 2301/056* (2013.01); *B22F 2301/058* (2013.01)

(58) Field of Classification Search
CPC .. B22F 1/0003; B22F 3/225; B22F 2301/056; B22F 2301/058; B22F 1/052; B22D 17/007; B22D 17/02; B22D 17/2038; B22D 21/007; B22D 21/04; C22C 21/00; C22C 23/02; C22C 1/0408
See application file for complete search history.

(56) References Cited

U.S. PATENT DOCUMENTS

2019/0060995 A1* 2/2019 Hideshima ..... B22D 17/2061

FOREIGN PATENT DOCUMENTS

| | | | |
|---|---|---|---|
| JP | 2000-212607 | A | 8/2000 |
| JP | 2001-303150 | A | 10/2001 |
| JP | 2004-230462 | A | 8/2004 |
| JP | 2011-125887 | A | 6/2011 |
| JP | 2019-044227 | A | 3/2019 |

OTHER PUBLICATIONS

Nandy et al., "Microstructure and Properties of Blended Mg—Al Alloys Fabricated by Semisolid Processing," Metallurgical and Materials Transactions, vol. 37A, Dec. 2006, pp. 3725-3736. (Year: 2006).*

Ohguchi et al., "Preparation of Ultra Fine-Grained Magnesium Alloy by Mechanical Alloying of AZ31 Chip-Aluminum Powder Mixture," JSME Int'l. J., Series A, vol. 46, No. 3, 2003, pp. 242-246. (Year: 2003).*

* cited by examiner

*Primary Examiner* — John A Hevey
(74) *Attorney, Agent, or Firm* — Global IP Counselors, LLP

(57) ABSTRACT

An injection molding material for magnesium thixomolding includes: a powder containing Mg as a main component; and a chip containing Mg as a main component, in which a proportion of the powder in the injection molding material for magnesium thixomolding is 5 mass % or more and 45 mass % or less, and a tap density of the powder is 0.15 g/cm$^3$ or more.

3 Claims, 5 Drawing Sheets

FIG. 4

| | | POWDER COMPOSITION | POWDER PROPORTION (wt%) | ADJUSTMENT OF TAP DENSITY | TAP DENSITY (g/cm$^3$) | AVERAGE VALUE OF PROOF STRESS (MPa) | DIFFERENCE BETWEEN AVERAGE VALUE AND MINIMUM VALUE OF PROOF STRESS (MPa) |
|---|---|---|---|---|---|---|---|
| SAMPLE 1 | REFERENCE EXAMPLE | – | 0 | – | 0.18 | 155 | 7 |
| SAMPLE 2 | EXAMPLE | A | 5 | a | 0.18 | 175 | 7 |
| SAMPLE 3 | EXAMPLE | A | 20 | a | 0.18 | 196 | 11 |
| SAMPLE 4 | EXAMPLE | A | 45 | a | 0.18 | 221 | 12 |
| SAMPLE 5 | REFERENCE EXAMPLE | A | 55 | a | 0.18 | 193 | 85 |
| SAMPLE 6 | REFERENCE EXAMPLE | A | 100 | a | 0.18 | 175 | 90 |
| SAMPLE 7 | REFERENCE EXAMPLE | A | 20 | b | 0.09 | 120 | 45 |
| SAMPLE 8 | REFERENCE EXAMPLE | A | 40 | b | 0.09 | NON-MOLDABLE | |

FIG. 5

| | | POWDER COMPOSITION | POWDER PROPORTION (wt%) | ADJUSTMENT OF TAP DENSITY | TAP DENSITY ($g/cm^3$) | AVERAGE VALUE OF PROOF STRESS (MPa) | DIFFERENCE BETWEEN AVERAGE VALUE AND MINIMUM VALUE OF PROOF STRESS (MPa) |
|---|---|---|---|---|---|---|---|
| SAMPLE 9 | EXAMPLE | B | 10 | a | 0.21 | 182 | 9 |
| SAMPLE 10 | EXAMPLE | B | 30 | a | 0.21 | 226 | 12 |
| SAMPLE 11 | REFERENCE EXAMPLE | B | 50 | a | 0.21 | 180 | 75 |
| SAMPLE 12 | REFERENCE EXAMPLE | B | 30 | b | 0.13 | 203 | 55 |
| SAMPLE 13 | EXAMPLE | C | 30 | a | 0.20 | 231 | 14 |
| SAMPLE 14 | REFERENCE EXAMPLE | C | 30 | b | 0.07 | 211 | 69 |
| SAMPLE 15 | EXAMPLE | D | 30 | a | 0.17 | 153 | 8 |

INJECTION MOLDING MATERIAL FOR MAGNESIUM THIXOMOLDING

The present application is based on, and claims priority from JP Application Serial Number 2020-050632, filed Mar. 23, 2020, the disclosure of which is hereby incorporated by reference herein in its entirety.

BACKGROUND

1. Technical Field

The present disclosure relates to an injection molding material for magnesium thixomolding.

2. Related Art

In recent years, components made of a magnesium alloy are used in products such as an automobile, an aircraft, a mobile phone, and a notebook computer. Since magnesium has a higher specific strength than iron, aluminum, or the like, the components manufactured using the magnesium alloy can be lightweight and have a high strength. In addition, since magnesium is abundant near a surface of the earth, magnesium has an advantage even in terms of resource acquisition.

Thixomolding is known as one of methods for manufacturing components made of magnesium. In the thixomolding, since a material is increased in fluidity by heating and shearing and injected into a mold, it is possible to mold a thinner component and a component with a complicated shape compared to a die casting method. Further, since the material is injected into the mold without being exposed to an atmosphere, there is also an advantage that a molded product can be molded without using a flameproof gas such as $SF_6$.

As a material for the thixomolding, a chip, a pellet, a powder, or the like is used. For example, JP-A-2019-44227 discloses a magnesium-based alloy powder used as the material for the thixomolding.

JP-A-2019-44227 shows that a molded product formed by using the above material has high strength. However, an inventor of the present application finds that when the thixomolding is performed using a powdered magnesium material as shown in JP-A-2039-44227, strength of the molded product may vary.

SUMMARY

According to a first aspect of the present disclosure, an injection molding material for magnesium thixomolding is provided. This injection molding material for magnesium thixomolding includes a powder containing Mg as a main component and a chip containing Mg as a main component. A proportion of the powder in the injection molding material for magnesium thixomolding is 5 mass % or more and 45 mass % or less, and a tap density of the powder is 0.15 g/cm$^3$ or more.

BRIEF DESCRIPTION OF THE DRAWINGS

FIG. 4 is a diagram showing experimental results.

FIG. 5 is a diagram showing experimental results.

DESCRIPTION OF EXEMPLARY EMBODIMENTS

A. Embodiment

Figure 1:
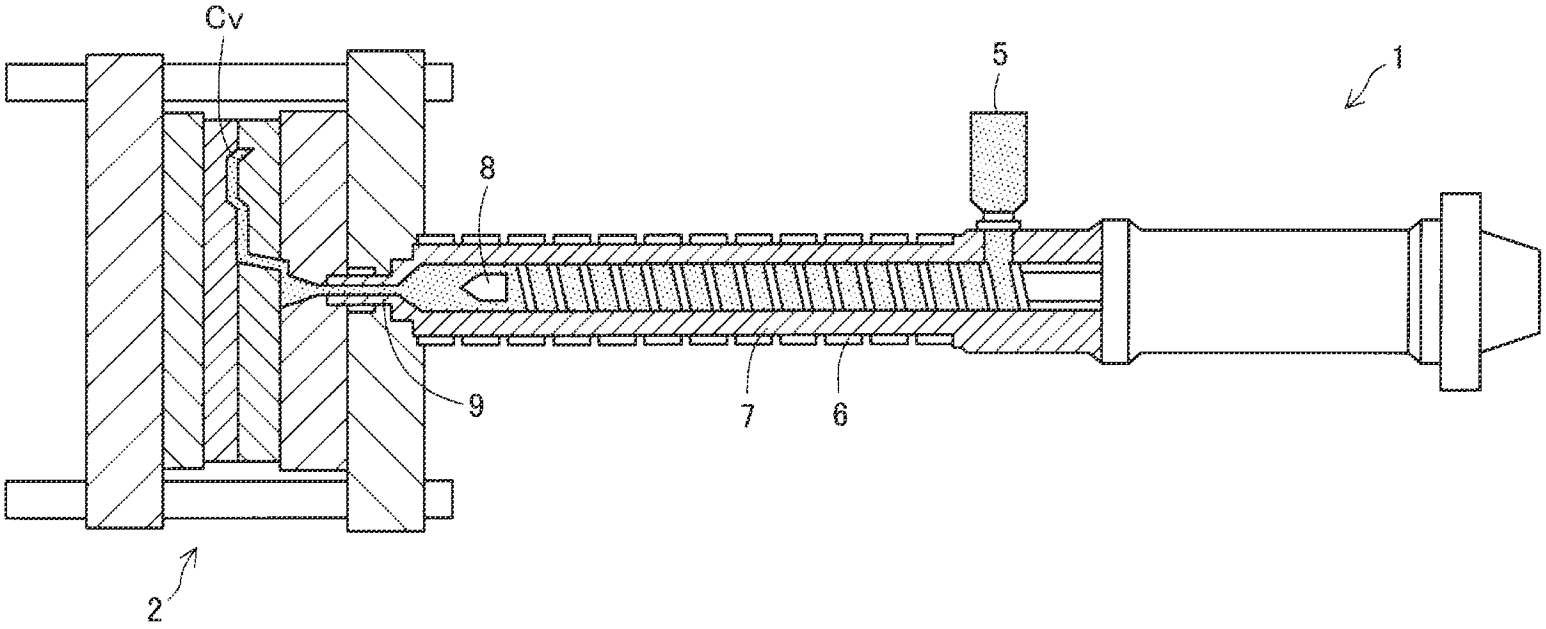
FIG. 1 is a schematic view showing an example of a configuration of an injection molding machine.

FIG. 1 is a schematic view showing an example of a configuration of an injection molding machine 1 used in thixomolding. The thixomolding is a method of slurrying a material such as a chip or a powder by heating and shearing, and injecting the slurry without exposing the slurry to the atmosphere to obtain a molded product having a desired shape. In the thixomolding, the molded product is generally molded at a lower temperature as compared to a die casting method or the like, and a structure of the molded product is likely to be uniform. Therefore, mechanical strength and dimensional accuracy of the molded product can be improved by molding the molded product by the thixomolding. In the present specification, a term "molded product" is simply referred to as a product molded by the thixomolding.

The molded product obtained by the thixomolding is used for components constituting various products. The molded product is used for, for example, in addition to components for transportation equipment such as components for automobiles, components for railroad vehicles, components for ships, and components for aircrafts, components for electronic devices such as components for personal computers, components for mobile phone terminals, components for smartphones, components for tablet terminals, components for wearable devices, and components for cameras, and various structures such as ornaments, artificial bones, and artificial tooth roots.

As shown in FIG. 1, the injection molding machine 1 includes a mold 2 that forms a cavity Cv, a hopper 5, a heating cylinder 7 including a heater 6, a screw 8, and a nozzle 9. When the thixomolding is performed by the injection molding machine 1, the material is first charged into the hopper 5. The charged material is supplied from the hopper 5 to the heating cylinder 7. The material supplied to the heating cylinder 7 is slurried by being heated in the heating cylinder 7 by the heater 6, and being transferred and sheared by the screw 8. The slurry is injected through the nozzle 9 into the cavity Cv in the mold 2 without being exposed to the atmosphere.

The injection molding material for magnesium thixomolding according to the present embodiment includes a powder containing magnesium (Mg) as a main component and a chip containing Mg as a main component. A proportion of the powder in the injection molding material for magnesium thixomolding is 5 mass % or more and 45 mass % or less. A tap density of the powder is 0.15 g/cm$^3$ or more. The main component refers to a substance having the highest content among substances contained in the powder or the chip. In addition, the injection molding material for magnesium thixomolding may be simply referred to as a "mixed material".

The chip refers to a section obtained by shaving or cutting an Mg alloy cast in a mold or the like. The chip may have a different composition or shape as long as the chip is a chip containing Mg as the main component. The chip may also be called a pellet.

The powder refers to a metal grain of the Mg alloy having a substantially spherical or scaly shape. The powder is preferably manufactured by an atomizing method, and more preferably manufactured by a high-speed rotating water flow atomizing method. Examples of the atomizing method include a water atomizing method, a gas atomizing method, or the like, in addition to the high-speed rotating water flow atomizing method. Further, the powder may be manufactured by a method other than the atomizing method, and may be manufactured by, for example, a reduction method, a carbonyl method or the like.

In the high-speed rotating water flow atomizing method, first, a coolant is ejected and supplied along an inner peripheral surface of a cooling cylinder, and then swirled along the inner peripheral surface of the cooling cylinder to form a coolant layer on the inner peripheral surface. Further, a raw material of the Mg alloy is melted, and an obtained molten metal is naturally dropped while a liquid or gas jet is sprayed onto the molten metal. As a result, the molten metal is scattered and miniaturized, and at the same time, the molten metal is blown off to the coolant layer and taken into the coolant layer. As a result, the scattered and miniaturized molten metal is rapidly cooled and solidified to obtain an Mg alloy powder. In the high-speed rotating water flow atomizing method, the raw material in a molten state is rapidly cooled in a short time, so that a crystal structure of the material is finer. As a result, a powder capable of molding the molded product having excellent mechanical properties can be obtained.

A pressure at a time of ejecting the coolant supplied to the cooling cylinder is preferably 50 MPa or more and 200 MPa or less. A temperature of the coolant is preferably −10° C. or higher and 40° C. or lower. As a result, the scattered molten metal is cooled appropriately and evenly in the coolant layer.

A melting temperature for melting the raw material of the Mg alloy is preferably set to, with respect to a melting point Tm of the Mg alloy, Tm+20° C. or higher and Tm+200° C. or lower, and more preferably Tm+50° C. or higher and Tm+150° C. or lower. As a result, a variation in characteristics among particles constituting the Mg alloy powder can be reduced to be particularly small.

In the high-speed rotating water flow atomizing method, for example, a particle size, the tap density, an average DAS, or the like of the produced Mg alloy powder can be adjusted by adjusting various conditions. The "average DAS" refers to an average dendrite secondary arm spacing. For example, the average DAS can be reduced by increasing a flow velocity or a flow rate of the coolant. In addition, by adjusting an amount of a flow-down of the molten metal, a flow velocity of the liquid or gas jet, or the flow velocity or the flow rate of the coolant, a particle size, a shape, a thickness of an oxide layer, and the tap density of the Mg alloy powder can be adjusted.

In the high-speed rotating water flow atomizing method, the molten metal may reach the coolant layer directly without using the liquid or gas jet. In this case, for example, a cooling housing is arranged so as to be inclined with respect to a direction of free fall of the molten metal. As a result, the molten metal reaches the coolant layer by the free fall and is taken into the coolant layer. In such a configuration, the molten metal is miniaturized and cooled and solidified by a flow of the coolant layer to obtain the Mg alloy powder having a relatively large particle size.

Since the powder has a finer structure than the chip and has less component segregation, strength of the molded product can be increased by using a powder material for the thixomolding. On the other hand, when a material formed of only the powder material is used for the thixomolding, the strength of the molded product may vary. The variation in the strength of the molded product is generated by, for example, a presence or an absence of air bubbles in the molded product. The air bubbles in the molded product are generated, for example, by entraining air when the material is injected into the mold. Since the screw of a commercially available thixomolding molding machine has a shape suitable for using the chip as the material, this air entrainment is likely to occur when the powder is used as the material. In particular, when the tap density of the powder is less than 0.15 g/cm$^3$, the powder is more likely to entrain air when being injected into the mold. The air bubbles in the molded product may also be called "voids".

The mixed material of the present embodiment is formed of the chip and the powder mixed in the above proportion. The tap density of the powder constituting the mixed material is 0.15 g/cm$^3$ or more. Therefore, by using this mixed material as the material for the thixomolding, the variation in the strength of the molded product is prevented as compared with a case where the material formed of only the powder material is used. Further, the strength of the molded product is improved as compared with a case where a material formed of only the chip is used.

The powder preferably contains calcium (Ca) as an additive component in addition to Mg which is the main component. An ignition temperature of the powder is increased by containing Ca in the powder. The mixed material is more likely to be processed more safely and efficiently by increasing the ignition temperature of the powder or the chip. Further, a content of Ca in the powder is more preferably 0.2 mass % or more. When the content of Ca in the powder is 0.2 mass % or more, the ignition temperature of the powder can be increased and the strength of the molded product can be higher. For example, the chip may contain Ca. Ca may exist in a form of a simple substance, an oxide, an intermetallic compound, or the like, for example, in the powder or the chip. Further, for example, Ca may be segregated at a grain boundary in a metal structure such as Mg or the Mg alloy, or may be uniformly dispersed in the powder.

The powder and the chip may contain, for example, aluminum (Al) as the additive component. An addition of Al to the powder reduces a melting point of the powder. Similarly, a melting point of the chip is reduced by adding Al to the chip. The mixed material is more likely to be processed more safely and efficiently by reducing the melting point of the powder or the chip. Al may exist in the form of a simple substance, an oxide, an intermetallic compound, or the like, for example, in the powder or the chip. Further, for example, Al may be segregated at the grain boundary in the metal structure such as Mg or the Mg alloy, or may be uniformly dispersed in the powder or the chip. Further, the powder and the chip may contain other components other than Mg, Ca, and Al described above.

The content of the additive component such as Ca in the powder or the chip can be measured, for example, by electron probe microanalysis (EPMA). The content of the additive component may be measured, for example, by optical emission spectroscopy (OES), X-ray photoelectron spectroscopy (XPS), secondary ion mass spectrometry (SIMS), auger electron spectroscopy (AES), Rutherford backscattering spectrometry (RBS), or the like.

The tap density of the powder can be measured according to JIS standard Z2512. Specifically, a sample weighed in units of 0.1 g is placed in a measuring container of 100 cm$^3$, and the measuring container is attached to a tapping device. After that, tapping is performed and a volume of the sample is read from a scale of the measuring container. The tap density is determined by dividing a mass of the sample by the volume of the sample. The measuring container may be a 25 $cm^3$ measuring container as shown in the JIS standard Z2512.

Figure 2:
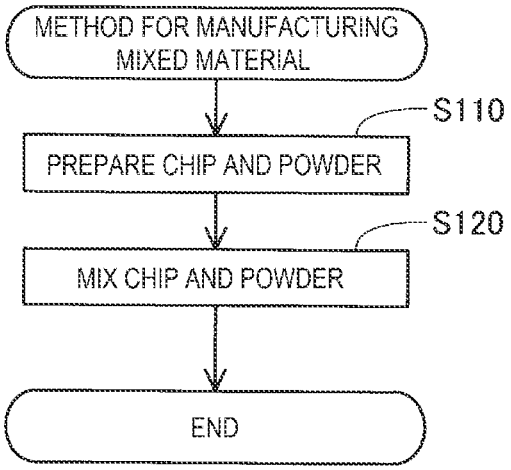
FIG. 2 is a process chart showing an example of a method for manufacturing a mixed material.

FIG. 2 is a process chart showing an example of a method for manufacturing a mixed material according to the present embodiment. As described above, the mixed material is manufactured by mixing the chip and the powder.

First, in step S110, the chip and the powder are prepared. Next, in step S120, the chip and the powder are mixed. In step S120, for example, the chip and the powder are placed in a one-liter container with a lid and shaken. As a result, the mixed material is manufactured.

Figure 3:
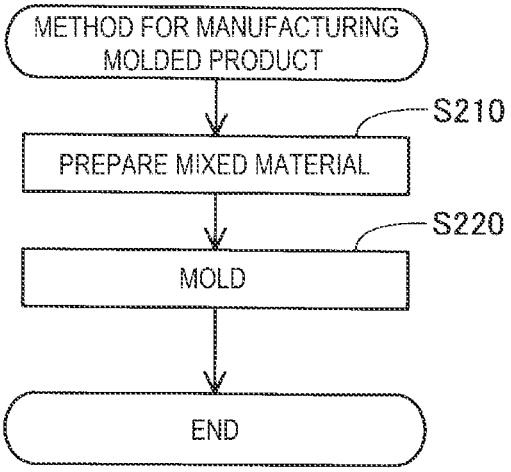
FIG. 3 is a process chart showing an example of a method for manufacturing a molded product.

FIG. 3 is a process chart showing an example of a method for manufacturing a molded product by the thixomolding using the mixed material. In order to manufacture the molded product, first, in step S210, the mixed material manufactured by the manufacturing method shown in FIG. 2 is prepared. Next, in step S220, molding is performed by the thixomolding. As a result, the molded product using the mixed material is manufactured.

A temperature of the slurry in the thixomolding is appropriately set according to a composition of the material, a shape of the cavity Cv, or the like. In the present embodiment, the temperature of the slurry is preferably set to 500° C. or higher and 650° C. or lower, and more preferably 550° C. or higher and 630° C. or lower. By setting the temperature of the slurry in the above range, a viscosity of the slurry is appropriate. As a result, the dimensional accuracy of the molded product is increased.

In the method for manufacturing a molded product in the present embodiment, the mixed material in which powder and the chip are mixed in advance is charged into the hopper 5 of the injection molding machine 1 shown in FIG. 1. Therefore, as compared with a case where the powder and the chip are separately charged into the injection molding machine 1, the material is uniformly dispersed in the heating cylinder 7, so that a state of the slurry injected into the mold 2 is stable. As a result, the strength of the manufactured molded product is stable. For example, the mixed material may be manufactured immediately before being charged into the injection molding machine 1. In this case, for example, a mixing mechanism may be provided in the hopper 5, so that a mixed material equivalent to the mixed material mixed in advance is manufactured in the hopper 5, and the mixed material manufactured in the hopper 5 is charged into the injection molding machine 1.

According to the mixed material of the present embodiment described above, the proportion of the powder in the mixed material is 5 mass % or more and 45 mass % or less, and the tap density of the powder is 0.15 g/$cm^3$ or more. Therefore, the variation in the strength of the molded product is prevented as compared with the case where the thixomolding is performed using the material formed of only the powder material. Further, the strength of the molded product is improved as compared with the case where the thixomolding is performed using the material formed of only the chip.

Further, in the present embodiment, the powder contains Ca. Therefore, the ignition temperature of the powder is increased, and the mixed material is more likely to be processed more safely and efficiently.

Further, in the present embodiment, the content of Ca in the powder is 0.2 mass % or more. Therefore, the ignition temperature of the powder is increased and the strength of the molded product is higher.

B. Experimental Result

Various mixed materials are prepared as experimental samples, and a proof stress test of the molded product molded using the mixed materials is performed to verify an effect of the above embodiment.

FIGS. 4 and 5 are diagrams showing experimental results. FIGS. 4 and 5 show a composition of the powder, the proportion of the powder, a presence or an absence of adjustment of the tap density of the powder, the tap density of the powder, an average value of a proof stress, and a difference between the average value and a minimum value of the proof stress in each sample. The proof stress in FIGS. 4 and 5 refers to the 0.2% proof stress of the molded product molded using each sample. The proof stress is measured by a three-point bending test.

Each sample is manufactured according to the manufacturing method shown in FIG. 2. First, the chip and the powder are prepared according to step S110. As the chip, a 4 mm×2 mm×2 mm chip of AZ91D manufactured by STU, Inc. is used. This chip is an Mg alloy chip containing nine mass percent of Al and one mass percent of Zn.

The powder is prepared as follows. First, the raw material is melted in a high-frequency induction furnace and pulverized by the high-speed rotating water flow atomizing method to obtain the Mg alloy powder. An ejection pressure of the coolant is 100 MPa. The temperature of the coolant is 30° C. The temperature of the molten metal is set to the melting point of the raw material+20° C.

In the present experiment, the powder having compositions A, B, C, and D is prepared. The "composition A" means that a content of Al is 9.5 mass % and a content of Ca is 0.25 mass % in the powder. The "composition B" means that the content of Al is 7.8 mass % and the content of Ca is 0.25 mass % in the powder. The "composition C" means that the content of Al is 7.0 mass % and the content of Ca is 4.7 mass % in the powder. The "composition D" means that the content of Al is 9.3 mass % and the content of Ca is 0.15 mass % in the powder.

In the present experiment, the tap density of the powder is adjusted by sieving the powder manufactured by the high-speed rotating water flow atomizing method. In FIGS. 4 and 5, a sample in which the tap density of the powder is adjusted is represented by "a", and a sample in which the tap density of the powder is not adjusted is represented by "b".

According to step S120 shown in FIG. 2, the chip and the powder described above are placed in the one-liter container with a lid, shaken and mixed to obtain each of the following samples. Sample 1 is formed of only the chip. Sample 6 is formed of only the powder. Therefore, in manufacturing of Sample 1, only the chip is prepared in step S110, and in manufacturing of Sample 6, only the powder is prepared in step S110. Further, in the manufacturing of Sample 1 and Sample 6, step S120 is omitted. Further, in Sample 2 to Sample 5, a balance of the powder is formed of the chip. For example, since a proportion of the powder in Sample 2 is 5 mass %, a proportion of the chip in Sample 2 is 95 mass.

Sample 1

A Chip

Sample 2 to Sample 5

A mixed material obtained by mixing a chip and a powder including the composition A and having an adjusted tap density Sample 6

A powder including the composition A and having an adjusted tap density

Sample 7 and Sample 8

A mixed material obtained by mixing a chip and a powder including the composition A and having an unadjusted tap density Sample 9 to Sample 11

A mixed material obtained by mixing a chip and a powder including the composition B and having an adjusted tap density Sample 12

A mixed material obtained by mixing a chip and a powder including the composition B and having an unadjusted tap density Sample 13

A mixed material obtained by mixing a chip and a powder including the composition C and having an adjusted tap density Sample 14

A mixed material obtained by mixing a chip and a powder including the composition C and having an unadjusted tap density Sample 15

A mixed material obtained by mixing a chip and a powder including the composition D and having an adjusted tap density According to the method for manufacturing a molded product shown in FIG. 3, the thixomolding is performed using each sample, and the molded product is manufactured. A magnesium injection molding machine JLM75MG manufactured by Japan Steel Works, Ltd. is used for manufacturing a molded product. The temperature of the slurry is 625° C. A mold temperature is 220° C.

Figure 6:
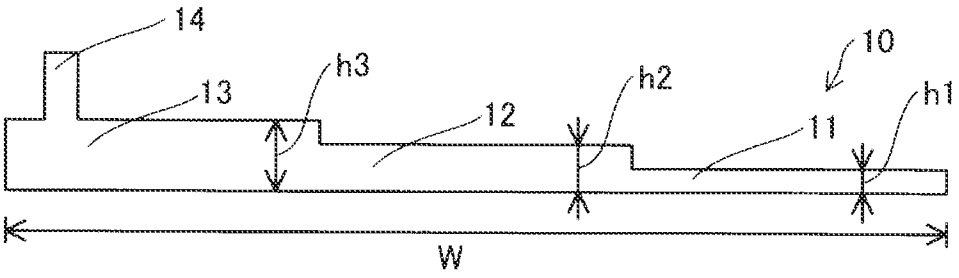
FIG. 6 is a cross-sectional view of a cavity of a mold used for molding each sample.

FIG. 6 is a cross-sectional view showing a cavity 10 of the mold used for manufacturing a molded product in the present experiment. That is, in the present experiment, the molded product is molded into a shape corresponding to a shape of the cavity 10. The cavity 10 has a flat columnar shape having a width W=150 mm, a depth D=50 mm, and a height of 1 to 3 mm. The depth D of the cavity 10 refers to a length of a paper surface in FIG. 4 in a thickness direction. The depth D is omitted in FIG. 6. The height of the cavity 10 is configured to gradually decrease from a third region 13 to a first region 11. Specifically, the first region 11 has a height h1=1 mm, a second region 12 has a height h2=2 mm, and the third region 13 has a height h3=3 mm. Widths of the respective regions are all 50 mm. A gate 14 is coupled to the third region 13. In a molding process, the slurry is injected into the cavity 10 through the gate 14.

As described above, the tap density of the powder is measured using the measuring container of 100 $cm^3$ according to the JIS standard Z2512.

A 0.2% proof stress of the molded product is measured as follows. First, 20 test pieces are prepared by cutting out test pieces having a width of 50 mm, a depth of 10 mm, and a height of 2 mm from the second region 12 shown in FIG. 6. Then, for each test piece, a three-point bending test is carried out with a distance between gauge points set to 40 mm. Further, the 0.2% proof stress of the molded product is measured using results of the three-point bending test.

As shown in FIG. 4, in Sample 2 to Sample 4, an average value of the proof stress is larger than that of Sample 1, and a difference between the average value and the minimum value of the proof stress is smaller than that of Sample 6, which is about the same as that of Sample 1. That is, a molded product molded by a sample having a powder proportion of 5 mass % or more and 45 mass % or less and a powder tap density of 0.15 $g/cm^3$ or more has a higher average value of the proof stress than that of the molded product molded only with the chip, and has a smaller difference between the average value and the minimum value of the proof stress than that of the molded product molded only with the powder, which is about the same as that of the molded product molded only with the chip. Since the powder has the finer structure than the chip, it is presumed that the average value of the proof stress is improved in Sample 2 to Sample 4. Further, in Sample 2 to Sample 4, it is presumed that a generation of the air bubbles in the molded product is prevented and the difference between the average value and the minimum value of the proof stress becomes small.

On the other hand, in Sample 5, the average value of the proof stress is larger than those of Sample 1 and Sample 6, but the difference between the average value and the minimum value of the proof stress is not reduced. Even in Sample 5, it is presumed that the proof stress is improved since the powder has a finer structure than the chip. On the other hand, in Sample 5, since the proportion of the powder contained in the sample is larger than those in Sample 2 to Sample 4, it is presumed that the generation of the air bubbles in the molded product is not effectively prevented. Further, in the sample 7, a decrease amount in the difference between the average value and the minimum value of the proof stress is small. Further, in Sample 8, a so-called short circuit occurs due to insufficient injection of the material, and the 0.2% proof stress of the molded product cannot be measured. In Sample 7 and Sample 8, since the tap density of the powder is smaller than those in Sample 2 to Sample 4, it is presumed that the generation of the air bubbles in the molded product is not effectively prevented.

As shown in FIG. 5, even for Sample 9, Sample 10, and Sample 13, the average value of the proof stress is improved and the difference between the average value and the minimum value of the proof stress becomes small as in Sample 2 to Sample 4. In Sample 15, the difference between the average value and the minimum value of the proof stress becomes small as in Sample 2 to Sample 4, but the average value of the proof stress is smaller than that of other samples represented as "Examples". It is presumed that a reason is that the content of Ca in Sample 15 is less than 0.2 mass %. That is, in the mixed material, the content of Ca is preferably 0.2 mass % or more. On the other hand, since the average value of the proof stress in Sample 15 is about the same as the average value of the proof stress in Sample 1, it is presumed that Sample 15 has a higher proof stress than the chip formed of only the chip having the same composition. In Sample 11, since the proportion of the powder contained in the sample is larger than that in the samples represented as "Examples", the decrease amount in the difference between the average value and the minimum value of the proof stress is small. In Sample 12 and Sample 14, since the tap density of the powder contained in the samples is smaller than those in the samples represented as "Examples", the decrease amount in the difference between the average value and the minimum value of the proof stress is small.

According to the experimental results described above, it is confirmed that when the proportion of the powder in the mixed material is 5 mass % or more and 45 mass % or less, and the tap density of the powder is 0.15 $g/cm^3$ or more, the variation in the strength of the molded product is prevented. It is also confirmed that the powder preferably contains Ca. Further, it is confirmed that the content of Ca in the powder is preferably 0.2 mass % or more.

C. Other Aspects

The present disclosure is not limited to the embodiments described above, and can be implemented in various forms without departing from the scope of the present disclosure. For example, the present disclosure can be implemented by the following aspects. In order to solve some or all of problems of the present disclosure, or to achieve some or all of effects of the present disclosure, technical characteristics in the above embodiments corresponding to technical characteristics in aspects described below can be replaced or combined as appropriate. In addition, when the technical characteristics are not described as essential in the present description, the technical characteristics can be deleted as appropriate.

1. According to a first aspect of the present disclosure, an injection molding material for magnesium thixomolding is provided. This injection molding material for magnesium thixomolding includes a powder containing Mg as a main component and a chip containing Mg as a main component. A proportion of the powder in the injection molding material for magnesium thixomolding is 5 mass % or more and 45 mass % or less, and a tap density of the powder is 0.15 g/cm$^3$ or more.

According to such an aspect, the variation in the strength of the molded product is prevented as compared with the case where a material formed of only the powder material is used for the thixomolding. Further, the strength of the molded product is improved as compared with the case where a material formed of only the chip is used for the thixomolding.

2. In the injection molding material for magnesium thixomolding according to the above aspect, the powder may contain Ca. According to such an aspect, the ignition temperature of the powder is increased, so that the injection molding material for magnesium thixomolding is more likely to be processed more safely and efficiently.

3. In the injection molding material for magnesium thixomolding according to the above aspect, a content of Ca in the powder may be 0.2 mass % or more. According to such an aspect, the ignition temperature of the powder is increased and the strength of the molded product is higher.

The present disclosure is not limited to the injection molding material for magnesium thixomolding described above, and can be implemented in various aspects. For example, the present disclosure can be implemented in a form of a molded product including the injection molding material for magnesium thixomolding.

What is claimed is:

1. An injection molding material for magnesium thixomolding, comprising:

a powder manufactured by an atomizing method, a reduction method, or a carbonyl method, and containing Mg as the main component; and a chip obtained by shaving or cutting an Mg alloy cast, and containing Mg as the main component, wherein a proportion of the powder in the injection molding material for magnesium thixomolding is 5 mass % or more and 45 mass % or less, and a tap density of the powder is 0.15 g/cm$^3$ or more.

2. The injection molding material for magnesium thixomolding according to claim 1, wherein the powder contains Ca.

3. The injection molding material for magnesium thixomolding according to claim 2, wherein a content of Ca in the powder is 0.2 mass % or more.

* * * * *